United States Patent [19]

Pechamat et al.

[11] 4,154,143

[45] May 15, 1979

[54] FIREARMS WITH EXTERNAL MOTOR

[75] Inventors: Jacques M. Pechamat; Joël M. Marcon, both of Bourges; Georges H. Simon, St. Germain du Puy, all of France

[73] Assignee: Etat Francais as represented by Delegue General Armement, Paris, France

[21] Appl. No.: 854,675

[22] Filed: Nov. 25, 1977

[30] Foreign Application Priority Data

Nov. 26, 1976 [FR] France ..... 76 35639

[51] Int. Cl.[2] ..... F41F 11/00

[52] U.S. Cl. ..... 89/11

[58] Field of Search ..... 89/11, 9, 7

[56] References Cited

U.S. PATENT DOCUMENTS

| | | | |
|---|---|---|---|
| 1,786,207 | 12/1930 | Hudson | 89/11 X |
| 3,241,448 | 3/1966 | Rocha | 89/9 X |
| 3,648,561 | 3/1972 | Stoner | 89/11 |
| 3,800,657 | 4/1974 | Broxholm et al. | 89/7 |

*Primary Examiner*—David H. Brown

*Attorney, Agent, or Firm*—Stevens, Davis, Miller & Mosher

[57] ABSTRACT

This disclosure relates to an automatic weapon having a breech mechanism driven in reciprocation by an external motor and equipped with a device to keep the breech mechanism from moving from the advanced or forward locked position in case of a hangfire. If a "shot departure" sensor fails to sense the departure of a shot a spring projects bolts into the path of the breech mechanism and locks it at the start of its recoil stroke.

11 Claims, 11 Drawing Figures

A
B
C
D
P
R
S
E
F
G
H
6a
6b
6c
a
b
c
d
l

X
Y
1
3
4
5
6
6a
6b
6c
7
8
9
10
18
A
B
C
D
E
F
G
H
P
R
S 5
6
7
11
A
B
C
D
E
F
G
H
M
N
P
R
S

FIREARMS WITH EXTERNAL MOTOR

This invention relates to automatic weapons which comprise a barrel which is fixed with respect to a breech casing, a cartridge chamber which is limited at the rear of the barrel by a movable breech mechanism, and an external motor capable of imparting the movable breech mechanism a movement of alternating translation which assures the opening and closing of the cartridge chamber. The external motor is, in general, an electric motor but it may also be hydraulic, pneumatic, or the like.

A weapon of the type defined in the preamble is described in particular in U.S. Pat. No. 1,216,938 (Brotherstone). In this case, the external motor is an electric motor which acts on the movable breech mechanism via a connecting rod and crank transmission.

One drawback of the known weapons of this type resides in the absence of safety in case of a hangfire, that is to say in case of a delay in explosion. As a matter of fact, due to the separation of the "fire" and "automatic" functions, the information as to the departure or non-departure of the shot is not supplied automatically to the logic of the automatic system, contrary to what takes place in a conventional weapon having an internal source of energy (intake of gas, recoil due to the momentum). Accordingly, ammunition which presents a hangfire may be extracted and ejected from the firing chamber before its normal operation and therefore may function, that is to say burn, in parts of the weapon and of the supporting system which are little, if at all, protected.

The object of the invention is to confer upon weapons of the type defined in the preamble, while retaining their intrinsic advantages, the principal advantage of the weapons with internal source of energy, that is to say safety in case of a hangfire.

In accordance with the invention, the automatic weapon of the type defined in the preamble is characterized for this purpose essentially by the fact that it has at least one bolt capable of locking the breech mechanism in advanced position with respect to the breech casing and urged elastically towards the trajectory of said breech mechanism; mechanical means which are sensitive to the position of the breech mechanism with respect to the breech casing and capable of maintaining the bolt out of action as long as the breech casing does not occupy an advanced position with respect to the breech casing; means sensitive to "shot departure" information and adapted momentarily to move the bolt out of said path at the time of the recoil stroke of the breech mechanism or to leave said bolt free, depending on whether these means receive such information or not; and a feed circuit for the external motor, which is coupled not only to a fire trigger switch but also to the said means sensitive to said information so as to interrupt said feed when said means do not receive this information.

In this way, as long as the operator acts on the fire trigger switch and the explosion of the ammunition takes place in normal manner, the means sensitive to the "shot departure" information upon each shot move the bolt away from the breech mechanism, so that the latter can thus move freely back and forth. The weapon therefore continues to fire until the operator releases the fire trigger switch. If, on the other hand, the cartridge is the seat of a hangfire, the means sensitive to the "shot departure" information are made incapable of freeing the bolt, which then immediately presents itself in the path of the breech mechanism at the start of its recoil stroke and locks the latter, therefore stopping the firing. As soon as the cartridge has burned or a sufficient period of safety has elapsed, the operator can return the breech mechanism forward, either manually or by means of an auxiliary control (motor, ram, electromagnet) after having retracted the bolt, whereupon the weapon is again ready to operate.

In accordance with a preferred embodiment, the bolt, or each bolt as the case may be, is a rotating bolt capable of presenting a locking nose in the path of a ratcheting integral with an operating part which constitutes the breech mechanism with a rotary breech head; and this bolt bears a toothed sector engaging with a slide-rack which is subjected, in opposite directions, to the action of a spring on the one hand and of means sensitive to the "shot departure" information on the other hand. The weapon advantageously comprises two such rotating bolts, the axes of which are parallel to that of the barrel and the two slide-racks are mounted slidably in a common recess, which is provided in the breech casing transversely with respect to the axis of the barrel. A single spring may then act simultaneously on both the slide racks. The mechanical means which are sensitive to the position of the breech mechanism with respect to the breech casing may be formed of elastic push members borne by the breech casing parallel to the axis of the barrel and located in such a manner as to cooperate with the noses of the rotating bolts and to be retracted upon each shot by contact with the moving breech mechanism.

The bolt, or each bolt, is advantageously connected to the breech casing by elastic means adapted to absorb the recoil energy of the breech mechanism. In the case of a rotating bolt, the latter is preferably mounted in a borehole of the breech casing parallel to the axis of the barrel so as to be able both to turn and to slide in said borehole. If the bolt is of tubular shape, it may be connected to the breech casing by a rod which passes longitudinally through it and which acts as a forward stop for it, the rod protruding at the front of the bolt so that it can be connected to the breech casing by elastic means working in compression in order to absorb the energy of recoil of the breech mechanism.

Although the means sensitive to the "shot departure" information may be governed by the pressure of the gases in the barrel, they are preferably related to the longitudinal position, with respect to a fixed cradle, of the breech casing, which is mounted in such a manner that it can recoil with respect to said stationary cradle. For this purpose, the slide rack, or each slide rack, may be urged elastically towards the outside in direction transverse with respect to the axis of the barrel so as to cooperate with a ramp borne by the cradle and adapted to displace it towards the inside upon each normal recoil of the breech casing. In this case, mechanical means are advantageously associated with said last mentioned ramp to cause it to advance momentarily with respect to the cradle in order to act on the slide racks in the same way as though they had recoiled with the breech casing with respect to the cradle, in order to eliminate the locking due to a hangfire.

The invention will be explained in further detail below with reference to the accompanying drawings, which illustrate a preferred embodiment of it.

Figure 11:
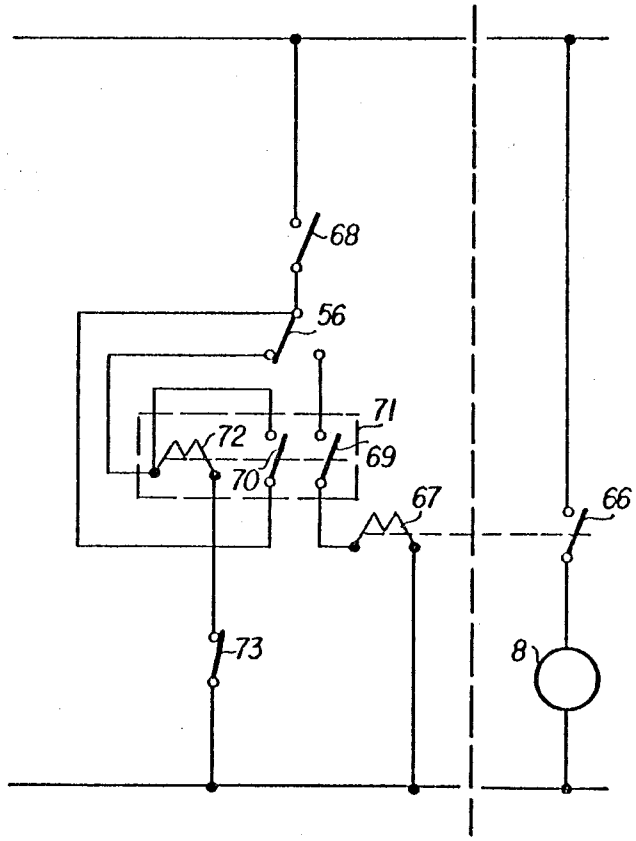

FIG. 11, finally, shows a partial electrical circuit of the automatic weapon with external motor.

The automatic weapon in accordance with the present invention comprises a barrel 1 (FIG. 1) whose axis X—X is stationary with respect to a breech casing 2 (see FIG. 4); a cartridge chamber 3, which is limited or terminated towards the rear of the barrel 1 by a breech mechanism 4; a rotary drum 5 whose lateral surface bears a helicoidal drive groove or ramp 6 of closed contour; a follower member 7 which cooperates with said ramp and which is firmly connected with the breech mechanism 4, which is guided in translation by the breech casing 2 parallel to the axis X—X; and an external motor 8 capable of turning the drum 5 in a constant direction around an axis Y—Y parallel to the axis X—X of the barrel 1. In the case of a double feed associated with the breech mechanism system, one of the methods of changing the direction of rotation consists in reversing the direction of rotation of the motor 8, which is made possible by the symmetry of the ramp 6. Nevertheless, in this case also one can say that for each of the two possibilities of feed, the motor 8 turns the drum 5 in a constant direction, in contra-distinction to an alternating movement.

The ramp or groove 6 comprises two segments, 6*a* and 6*b*, inclined in opposite directions, which assure the recoil and advance respectively of the movable breech mechanism 4 and which are connected on one side by a non-inclined portion 6*c* which assures the locking of said movable breech mechanism during the period of time corresponding to the duration of the firing and to the emptying of the gases. The motor 8 is generally an electric motor which is fed via the fire trigger switch (shown at 56 in FIG. 11) and the speed of which may be regulated in such a manner as to vary the rate of fire.

The control ramp 6 has a constant inclination over the major part of the segments 6*a* and 6*b*. The movable breech mechanism 4 assures the transfer of the ammunition 9 which is fixed in the breech head 10.

Figure 2:
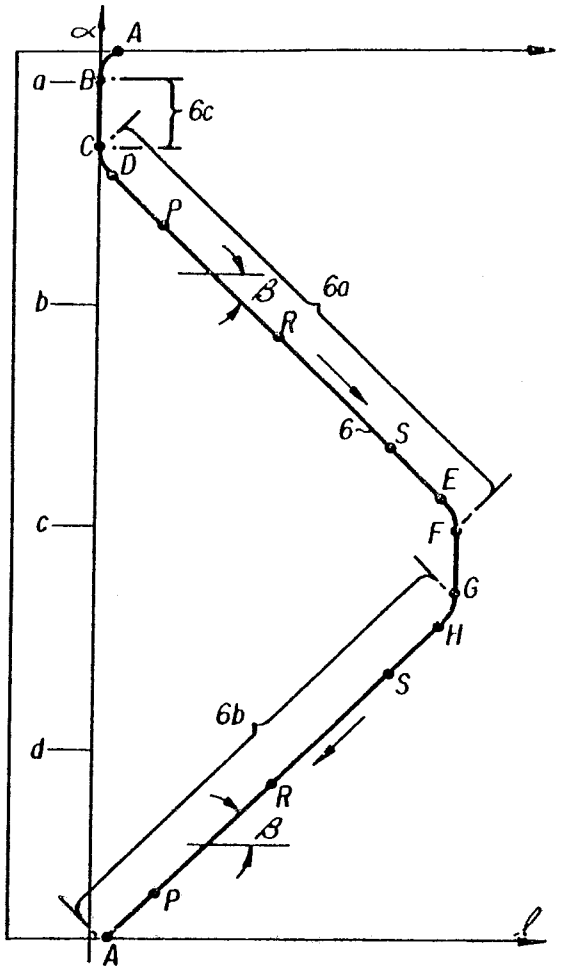
FIG. 2 illustrates the longitudinal stroke of a breech mechanism with respect to the angular distance of the rotating drum of FIG. 1.

The shape thus imparted to the ramp 6 is illustrated on a larger scale by the curve of FIG. 2, in which there has been entered, on the abscissa, the longitudinal stroke 1 of the movable breech mechanism 4 (in accordance with the arrangement of FIG. 1) and, on the ordinates, the angular distance $\alpha$ traversed by any point of the drum 5 during each operating cycle.

The start of the cycle, represented at the point A, corresponds to the end of the locking of the breech head 10 and the ignition of the primer of the ammunition 9. The portion of the curve AB corresponds to the deceleration of the breech mechanism 4 in its forward movement (towards the left in FIG. 1). The straight-line segment BC represents the non-inclined portion 6*c* of the ramp. The curved portion CD corresponds to the acceleration of the breech mechanism 4 in its rearward movement. The duration of the firing is covered by the time of rotation, which corresponds substantially to the ramp segment AD. The curved portions EF and GH corresponds to the deceleration of the breech mechanism 4 in its rearward movement, respectively. The straight line segment FG represents the time of halt of the movable breech mechanism 4 in rear position, during which time the ejection of the shell of the ammunition fired is effected as well as the placing of new ammunition on the breech head 10. The segment 6*a* has a constant inclination over the major part DE of its length (movement of the breech mechanism 4 at constant speed towards the rear), and the segment 6*b* has a constant inclination over the major part HA of its length (movement of the breech mechanism 4 at constant speed towards the front). The angle of inclination $\beta$ of the portions DE and HA is preferably on the order of 45°, referred to the axis X—X.

Figure 1:
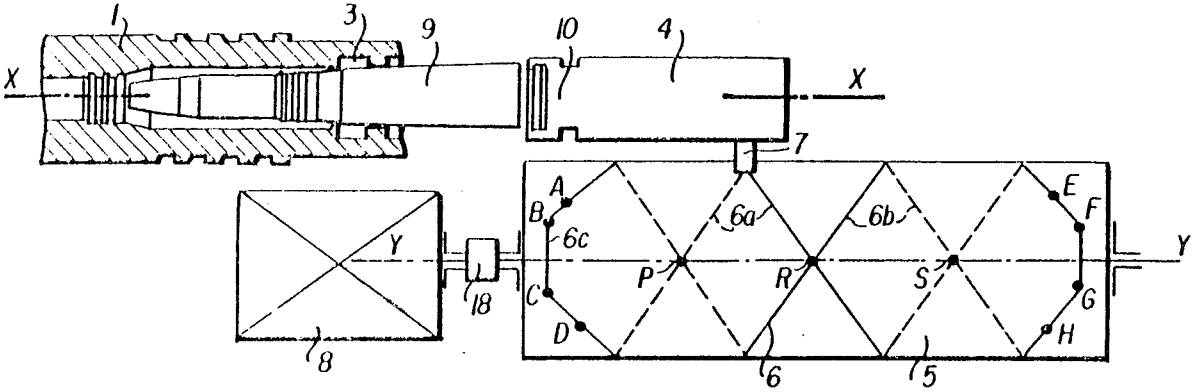
FIG. 1 shows the basic diagram of the weapon, whose breech mechanism is connected to a drum which is provided for this purpose with a drive ramp.
Figure 3:
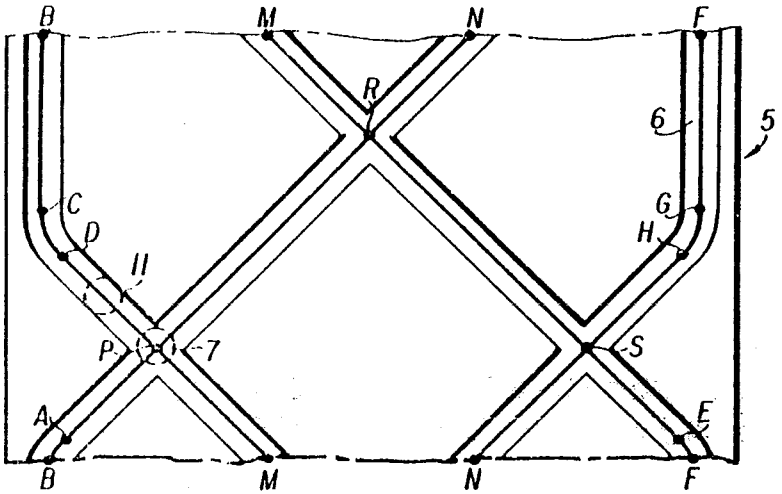
FIG. 3 is a developed view of the outer surface of the drum in FIG. 1 shown in a plane.
Figure 4:
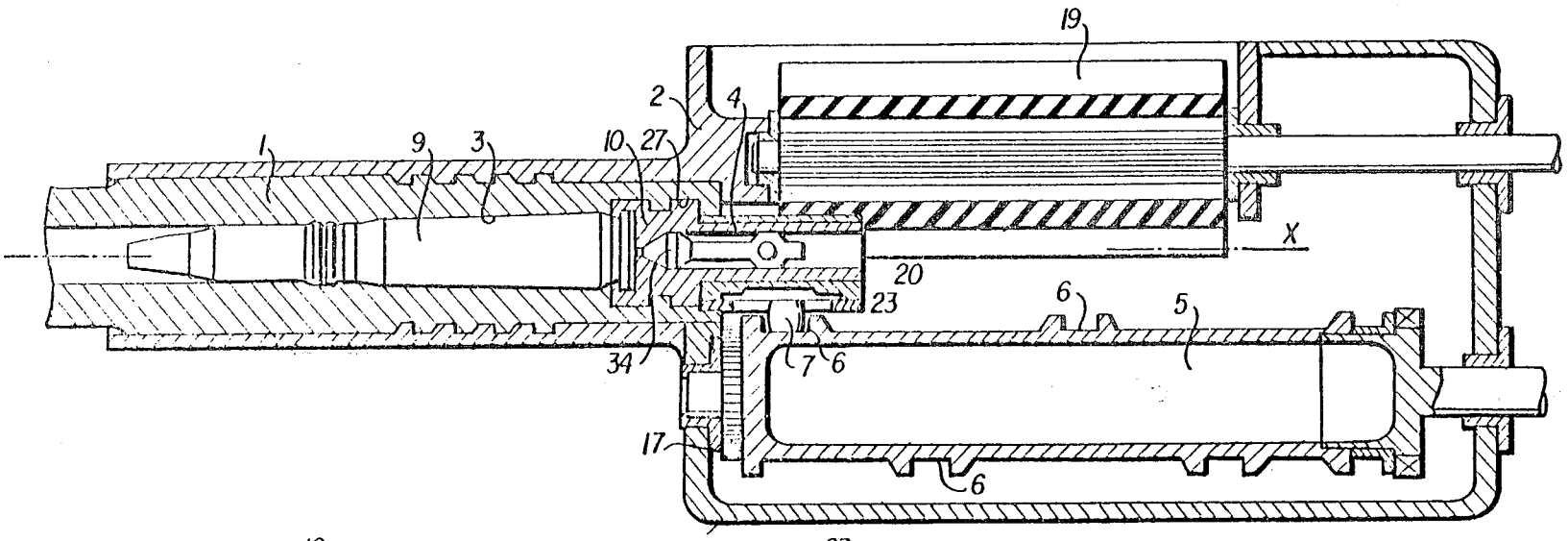
FIG. 4 shows, in section along a plane passing through the axis of the barrel, the rear of the barrel, the movable breech mechanism, and its drive drum.

In accordance with one advantageous construction, the drive ramp 6 extends over n revolutions of the drum 5, in which n is a number equal to at least 3, and the portions of constant inclination of the segments 6*a* and 6*b* of the ramp 6 cover the n-1 intersections of these two segments. In particular, according to the preferred embodiment of the invention which is shown in FIGS. 1, 3 and 4, the ramp 6 extends over four revolutions of the drum 5 and comprises three intersections P, R and S. FIG. 3 is a developed view of the outer surface of the drum 5 shown in a plane. For this, the cylindrical outer surface of the drum 5 has been cut by a half plane passing through the axis Y—Y and developed on the plane of FIG. 3, the trace of this half-plane being represented by the two horizontal dash-dot lines which limit FIG. 3 at the top and at the bottom. In other words, it can be considered that the ramp 6 has been traced in FIG. 3 with the same abscissa as in FIG. 2 (horizontal stroke of the movable breech mechanism 4). As to the ordinate of FIG. 3, it can be deduced easily from that of FIG. 2. As a matter of fact, it is merely necessary to divide the curve of FIG. 2 into four equal horizontal sections which corresponds to the successive revolutions of the drum 5 and to transfer each of these four sections between the two horizontal dot-dash lines in FIG. 3. By way of indication, the limits of these sections have been indicated at a, b, c and d in FIG. 2. A similar correlation could be established between FIGS. 2 and 3 in the event that the number n of revolutions were equal, for instance, to 3 or 5. It should be noted that FIG. 3 also differs from FIG. 2 by the fact that the limits of the groove forming the ramp 6 have been added to it.

It will be understood that at the intersections P, R and S, the follower member 7 is offered three different paths. In order to remove any indetermination with respect to the choice of passage at these intersections, the follower member 7 is formed by a roller which is associated with a guide roller 11, see FIG. 5. The two rollers 7 and 11 are engaged in the groove 6 which is provided on the outer surface of the drum 5 and the profile of which can be noted from FIG. 4, and these rollers are borne by a plate 12 which is mounted on the breech mechanism 4 in such a manner that it can turn with respect to the latter around an axis parallel to the axes of the two rollers 7 and 11, these three axes being vertical in FIG. 5 and perpendicular to the plan view of FIG. 6. The turning plate 12 comprises a first set of two parallel guide surfaces 13 and a second set of two parallel guide surfaces 14 which cooperate alternately with two flat guide surfaces 15 borne by the breech casing 2, see FIG. 7. The guide surfaces 15 are arranged parallel to the axis X—X of the barrel 1 and extend over an axial zone of the drum 5 which is shorter than that in which the portions of constant inclination of the two segments *6a, 6b* of the ramp 6 are located, but so determined as to cover all the intersections P, R, S of the ramp. When the angle of inclination $\beta$ is equal to 45°, the surfaces 13 and 14 are perpendicular in pairs, so that the part 12 has, at their level, a square profile, which can be seen in FIG. 6; if this angle is other than 45°, this profile has the shape of a diamond.

FIGS. 4 to 7 show details of construction of the preferred embodiment of the invention.

FIG. 4 shows a section through the breech mechanism in forward position; this is the position in which the breech mechanism 4 is locked on the barrel 1 at the time of ignition. Within the breech casing 2 bearing the barrel 1, the breech mechanism 4 is driven in an alternate movement of translation and the drum 5 is driven in a movement of rotation. This drum is rigidly connected with a pinion 17 which forms part of a gear train 18 (FIG. 1) which connects the shaft of the motor 8 to the drum 5. At the rear end of said drum 5 (on the right-hand side of FIG. 4) a mechanism (not shown) permits the driving of the ammunition feeding system and, in particular, of a feed and ejection spider 19 (see also FIG. 7).

Figure 5:
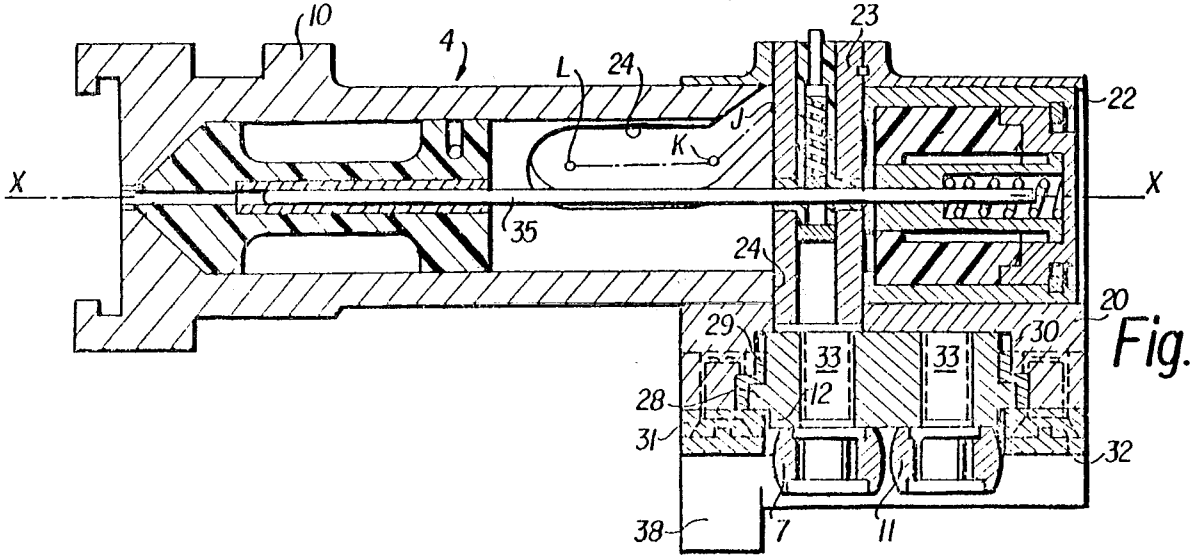
FIG. 5 is a section view along a plane perpendicular to that of FIG. 4 of the breech mechanism and roller holder plate of the apparatus of FIG. 4.
Figure 7:
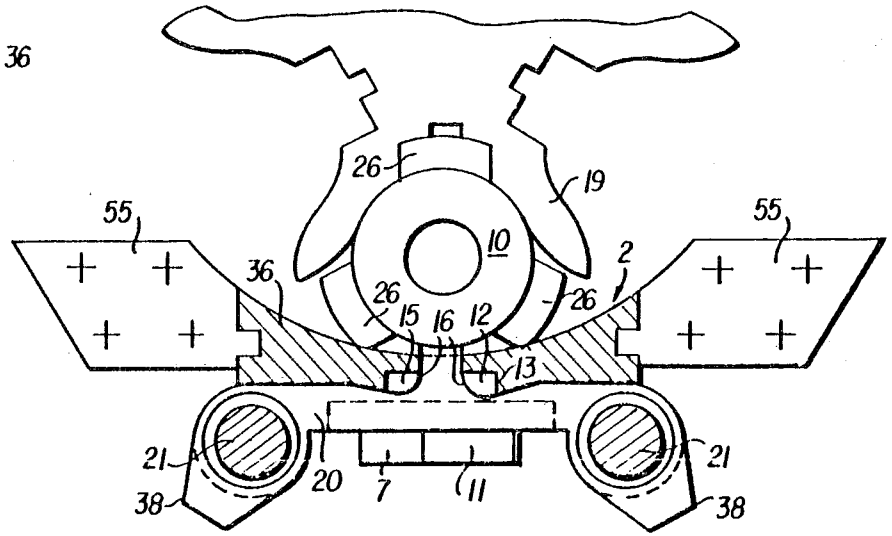
FIG. 7 is yet another illustration of the roller holder plate of the breech mechanism of FIG. 4.
Figure 6:
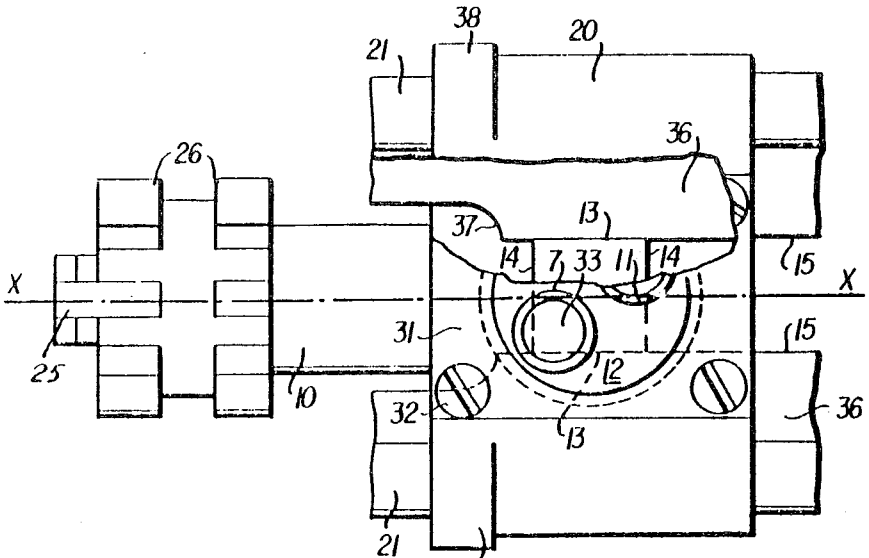
FIG. 6 is an illustration of the roller holding plate of the breech mechanism of FIG. 4.

The movable breech mechanism 4 is formed of the breech head 10 and of an operating part 20 (see also FIGS. 5, 6 and 7). The operating part 20 is guided by two rods 21 (FIGS. 6 and 7) which are rigidly connected with the breech casing 2 and arranged parallel to the axis X—X. This part 20 is provided with a borehole 22 (FIG. 5) in which the breech head 10 can turn and it bears a transverse finger 23 (see also FIG. 4) which passes through the breech head via two diametrically opposite guides or ramps 24. Each of these ramps 24 comprises a rear segment parallel to the axis X—X (in which segment the finger 23 in FIG. 5 is engaged), a helicoidal intermediate segment JK, and a front segment KL parallel to the axis X—X. FIG. 5 shows a position occupied by the finger 23 and the breech head 10 upon the displacement of the movable breech mechanism in translation. Upon this displacement, the breech head 10 is locked in rotation by engagement of a stud 25 (FIG. 6) in a groove 16 (FIG. 7) parallel to the axis X—X. When the breech head 10 comes against the rear edge of the barrel 1, the operating part 20 continues to advance and the finger, first of all, describes the helicoidal segment JK, which causes the breech head 10 to rotate, its stud 25 having then gone beyond the zone of action of its groove 16. Upon this turning, the breech head 10 is locked, on the rear of the barrel 1, by the penetration of locking teeth 26 (see also FIG. 7) into notches 27 (see FIG. 4), which are provided for this purpose at the rear of the barrel 1. The point K of the ramps of the breech head 10 (FIG. 5) corresponds to the moment of firing at the end of locking, the segment KL being traversed after the firing. The movements of translation and rotation are reproduced in inverse order upon the recoil of the movable breech mechanism 4. The firing can be effected (as illustrated in FIG. 4) by means of a firing pin 34 or (as illustrated in FIG. 5) electrically by means of an insulated central contactor 35, the electric current being fed to said contactor 35 via the shaft of the finger 23.

As shown in FIGS. 5 and 6, the turning plate 12 has the shape of a cylinder of revolution bearing a small annular collar 28 on its outside. This plate is engaged, with the interposition of an anti-friction ring 29, in a cylindrical recess 30 provided for this purpose in the part 20 and it is held in this recess by a plate 31 which is fastened by screws 32 to the part 20. The axis of the cylindrical recess 30 is thus identical with the axis of rotation of the rotating plate 12. The latter bears two pivots 33 which are parallel to said axis and on which there the rollers 7 and 11 respectively are mounted for free rotation. As shown in FIG. 7, the operating part 20 is notched laterally towards the top so as to permit the guide surfaces 13 and 14 of the plate 12 to appear and enable them to come into contact with the stationary guide surfaces 15. The latter are provided on floors 36 and terminate, in front and at rear, at clearances 37 (FIG. 6) which permit the rotation of the rotating table 12 outside the zone of the intersections P, R and S. The floors 36 are part of the recoiling rigid assembly, the stationary part or cradle being visible in FIG. 7 at 55.

The automatic weapon which has just been described operates in the following manner. When the person using it acts on the fire trigger, he causes the feeding of the electric motor 8. Via the gear train 18, the latter rotates the drum 5 and the spider 19. Due to the engagement of the rollers 7, 11 in the groove of the drum 5 which constitutes the ramp 6, the operating part 20 effects one forward and return movement along the guide rods 21 each time that the drum 5 turns four revolutions. During this forward and return movement, the sequence of operations corresponding to the cycle A, B, C, D, P. (M), R, S, E, F, G, H, S, (N), P, A which has been described above takes place, the breech mechanism 4 being in rearward position upon the starting and the stopping. The points M and N are not particular points of the cycle but have been each entered in FIG. 3, both on top and on bottom, to indicate the continuity of the two portions of constant inclination of the ramp 6, namely the portions DPRSE and HSRPA. On each of these two portions, the rotating plate 12 is held, by contact of its surfaces 13 or 14 with the stationary guide surfaces 15, in the angular position desired in order that the plane of the axes of the rollers 7, 11 remains inclined by the angle $\beta$ with respect to the axis X—X of the barrel 1.

Therefore, at each intersection P, R, S, the roller 7 which first arrives is prevented from moving away from its path and straying off, or at least striking a point of the switch. Let us consider, for instance, the position shown in dot-dash line in FIG. 3 where the roller 7 is arriving at the intersection P, descending from the left to the right, and will therefore be normally free to deviate 90°. However, the roller 7 is maintained on the proper path by the rotating plate 12, assisted by the roller 11. Likewise, when the roller 11 arrives at the intersection P it is held on the proper path by the rotating plate 12, assisted by the roller 7.

As soon as the rollers 7 and 11 have cleared the last intersection of the sector 6a or 6b, the guide surfaces 13 or 14 of the turning plate arrive at the level of the front or rear clearances 27, so that the plate 12 is free to turn under the combined action of the rollers 7 and 11. The latter can therefore follow the segments EFGH or ABCD of the ramp 6, without encountering an intersection, and then re-engage the guide surfaces 14 or 13 of the turning plate 12 between the stationary guide surfaces 15, and so on.

In the foregoing, it has been assumed that the ammunition 9 was of the type with shell. It goes without saying that the invention can also apply to shell-less ammunition or ammunition with combustible shell. It would then be sufficient to adapt the breech head 10 to this latter type of ammunition by incorporating suitable sealing members in it.

Figure 10:
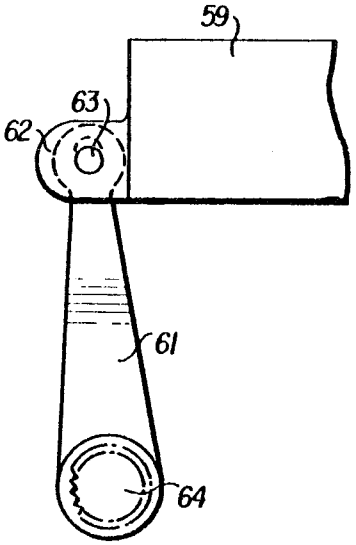
FIG. 10 is a side view of FIG. 8.
Figure 8:
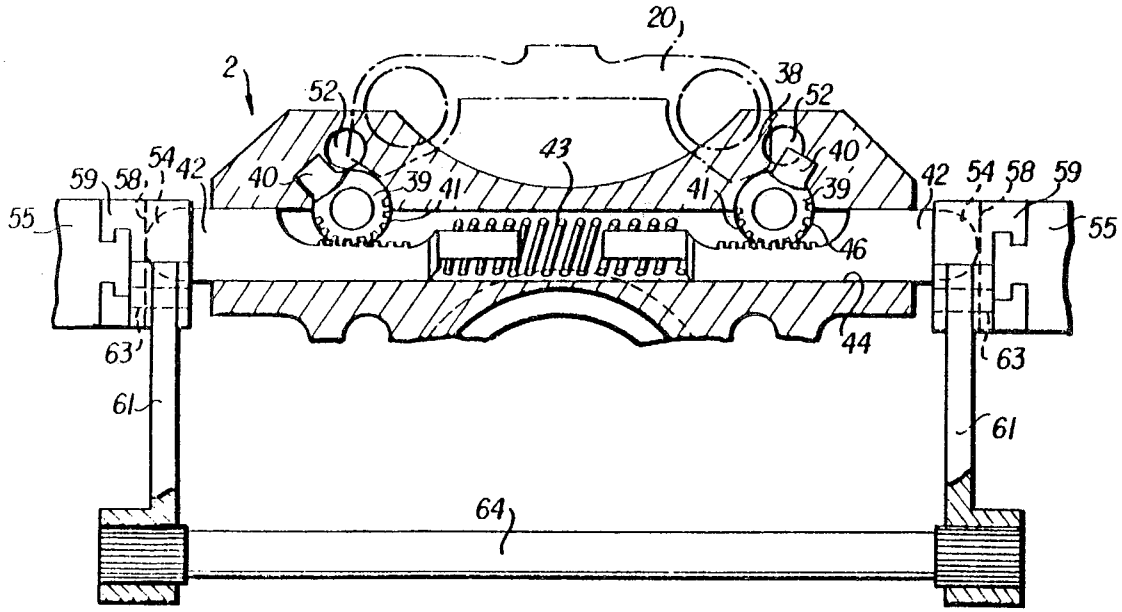
FIG. 8 illustrates one embodiment of the safety device of this invention.
Figure 9:
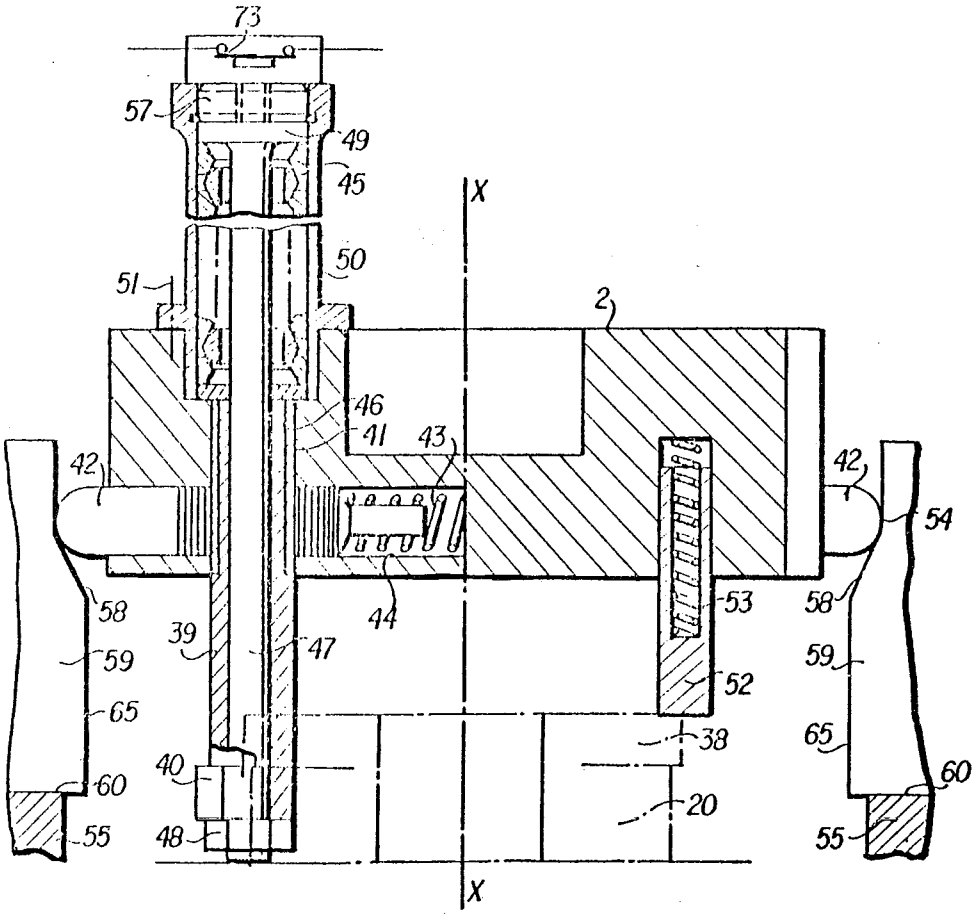
FIG. 9 is a sectional view along a plane parallel to the X—X axis of FIG. 8.

In accordance with the invention, the weapon which has just been described has a safety device for hangfire which is shown in FIGS. 8, 9 and 10. FIG. 8 is a cross-sectional view along a plane perpendicular to the axis X—X of the barrel, FIG. 9 is a sectional view along a plane parallel to said axis, and FIG. 10 is a side view of certain of the parts of FIG. 8. In particular, FIG. 9 shows two partial half views which are separated by a dot-dash line coinciding with the representation of the axis X—X and in which certain parts have been eliminated in order to facilitate understanding; the complete mechanism is, as a matter of fact, entirely symmetrical.

The principle of the safety device consists in associating with the stopping (possibly assisted by a braking operation) of the external motor 8, an elastic blocking of the movable breech mechanism 4.

For this purpose the weapon has:

two bolts 39 capable of locking the breech mechanism 4 in advanced position with respect to the breech casing 2, which bolts are urged elastically towards the path of said breech mechanism 4;

mechanical means sensitive to the position of the breech mechanism 4 with respect to the breech casing 2 and capable of holding the bolts 3 out of action as long as the breech mechanism 4 does not occupy an advanced position with respect to the breech casing 2;

means sensitive to "shot departure" information and adapted momentarily to retract the bolts 39 from said path at the beginning of the recoil stroke of the breech mechanism 4 or to leave said bolts free, depending on whether said means receive such information or not;

and a feed circuit for the external motor 8, which circuit is coupled not merely to the fire trigger switch but also to the said means which are sensitive to said information so as to cut off said feed when said means do not receive said information.

Each bolt is a rotating bolt which is capable of presenting a locking nose in the path of a ratchet 38 integral with the operating part 20. These turning bolts each bear a toothed sector 41 which meshes with a slide rack 42, subjected in opposite directions to the action of a spring 43 on the one hand and means sensitive to the "shot departure" information on the other hand. The axes of the bolts 39 are parallel to the axis X—X of the barrel 1. The two slide racks 42 are mounted slidably in a common housing 44 which is provided in the breech casing 2, transversely with respect to the axis X—X. The spring 43, which is housed at the center of said housing 44, acts simultaneously on the two slide racks 42.

The mechanical means sensitive to the position of the slide 4 with respect to the breech casing 2 are formed of two locking push members or fingers 52 mounted on the breech casing 2 in such a manner as to be able to slide parallel to the axis X—X and each urged towards the rear by a spring 53. These fingers 52 are located in such a manner as to cooperate with the noses 40 of the bolts 39 respectively and to be retracted upon each slot by contact with the front of the operating part 20.

The bolts 39 are connected to the breech casing 2 by elastic means 45, adapted to absorb the energy of recoil of the breech mechanism 4. Each bolt 39 is mounted in a borehole 46 of the breech casing 2, parallel to the axis X—X, so as to be able to both turn and slide in the said borehole 46. Its toothed sector 41 is sufficiently long (see FIG. 9) to remain in engagement with the corresponding slide rack 42 despite the longitudinal displacements of the bolt 39 in question. Whatever the longitudinal position of the latter, its nose 40 remains outside the breech casing 2.

Each bolt 39 has a tubular shape and it is traversed longitudinally by a rod 47 against which it is abutted towards the rear by a nut 48 screwed onto the rear end of the rod 47. Each rod 47 protrudes to the front of the bolt 39 to be able to be connected to the breech casing 2 by the elastic means 45 which work in compression. In accordance with the preferred embodiment, these elastic means are formed of a stack of spring rings or biconical washers which surround the front outer portion of the rod 47 and rest in front against the rod via a head 49 which is fastened to the end of the rod 47 or made in a single piece with it. The spring rings 45 which rest at the rear against the breech casing 2 and at the front against a nut 57 screwed internally in a cylindrical tubular housing 50 are arranged on the inside of said housing. This tubular housing 50 is fastened to the breech casing 2 by means of screws 51, one of which is indicated diagrammatically by its axis in FIG. 9. In position of rest, the dimensions are such that there is slight longitudinal play (a few tenths of a millimeter) between bolt 39 and rod 47, so as to permit easy rotation of the bolt 39. Otherwise this bolt would be, in actual fact, subjected to rubbing forces caused by the action of the elastic system. This play is obtained by an adjustment by means of a nut 57 which affects the pretension of the spring rings 45.

The means sensitive to the "shot departure" information are related to the longitudinal position, referred to the fixed cradle 55, of the breech casing 2 which is mounted in such a manner that it can recoil upon each shot with respect to said fixed cradle 55. For this purpose, the slide racks 42 are urged outwards by the spring 43 in direction transverse with respect to the axis X—X so that each cooperates with a ramp 58 borne by a part 59 and adapted to displace the slide racks 42 towards the inside upon each normal recoil of the breech casing 2. The two parts 59 slide in slideways (not shown) borne by the cradle 55 and at all times rest against transverse faces 60 of the cradle 55 upon normal operation.

FIGS. 8 and 10 show a mechanism solution which is adapted to assure the displacement towards the front of the parts 59 bearing the ramps 58, for purposes which will become evident further below. This mechanism comprises two levers 61 which act via yokes 62 and pins 63 on the parts 59. These two levers 61 are coupled by a connecting shaft 64, which is mounted in the cradle 55. This mechanism has a positive drive in both directions, which may either be manual or comprise a servo motor, and may act either on the shaft 64 or on one of the levers 61.

FIG. 11 shows a partial electrical diagram of the automatic weapon. In this figure, a vertical dash line separates the following two circuits; on the left, the drive circuit and on the right, the power circuit feeding the external motor 8. The power circuit comprises a switch 66 which is controlled by a coil 67, on the feed circuit of which there are mounted in series a main switch 68, the (fire trigger) switch 56 (shown in stop position), and one, 69, of the two contacts 69, 70 of a relay 71. The coil 72 of this relay may be fed in parallel by two circuits passing through the main switch 68 and through a "hangfire" safety contact 73 which is located in the nut 57 (FIG. 9); one of these circuits passes through the fire switch 56 when the latter is in the stop position shown, and the other passes through the contact 70 of the relay 71 when the fire switch 56 is in its fire position.

The hangfire safety device which has just been described opertes in the following manner, first of all under normal conditions and then, in the case of a hangfire.

1. Normal Conditions

As has been explained above with reference to FIGS. 1 to 7, when the breech head 10 comes against the rear edge of the barrel 1, the displacement of the operating part 20 causes the locking of said breech head by rotation. At the end of the rotation, the ignition takes place. The operating part 20 continues its movement in forward direction (stroke KL, FIG. 5) for the duration of the shot.

During its forward movement, the operating piece 20 pushes in the locking fingers 52 (FIGS. 8 and 9) which, at the end of the forward stroke, release the locking noses 40 of the turning bolts 39. During this time, the "shot departure" information has been noted on the recoil of the breech casing 2 and the outer faces 54 of the slides 42 are in contact with blocking surfaces 65 borne by the parts 59, on the rear of the ramps 58. (As a variant, the slides 42 are pushed towards the inside by means sensitive to the pressure of the gases in the barrel 1). In normal operation, the hangfire safety device is therefore neutralized at any time. When the operating part 42 departs again towards the rear, it releases the fingers 52 which, pushed back by the springs 53, then block the turning bolts 39, so as to assure the locking when the weapon is returned to firing position.

2. Case of a hangfire

In this case, the "shot departure" information is no longer recorded and therefore the faces 54 of the slides 42 are no longer in contact with the blocking surfaces 64 borne by the cradle 55 of the weapon but are opposite the clearances of the ramp 58, which permit them to expand transversely.

When the ignition has taken place, the operating part 20 pushes-in the fingers 52 which release the turning bolts 39. The slides 42 being no longer immobilized, these turning bolts 39 turn under the action of the spring 43 transmitted by the slides 42 and place the noses 40 behind the ratchetings 38 borne by the operating part 20. On the righ-hand side of FIG. 8, the turning bolts 39 are shown during the course of rotation. This movement takes place during the time that the operating part 20 is locked in forward position under the action of the ramp 6 (see FIG. 2).

When the ramp 6 causes the recoil of the operating part 20, the ratchetings 38, via the noses 40, the nuts 48 and the rods 47 compress the sets of spring rings 45. These spring rings assure the elastic blocking of the moving parts.

The end of compression takes place when the kinetic energy stored in the moving parts is equal to the potential energy stored in the spring rings 45. In order to avoid the unlocking of the breech head 10, the compression stroke is chosen less than or equal to the stroke KL of the locking ramps 24 (see FIG. 5).

The stopping of the motor 8 is controlled, at the time of the detection of the hangfire, by the displacement of the rods 47, which causes the opening of the switch 73 of FIG. 11, and the operation as brake of the motor 8 can possibly participate in the stopping of the mechanism.

What is claimed is:

1. Automatic weapon which comprises a barrel which is stationary with respect to a breech casing, a cartridge chamber which is limited at the rear of the barrel by a movable breech mechanism, said breech mechanism having a follower for imparting an alternating movement of translation to said breech mechanism which assures the opening and closing of the cartridge chamber, characterized by the fact said automatic weapon has at least one bolt connected to said breech casing by elastic means, said bolt being urged in the direction of said breech mechanism and having a locking portion locking the breech mechanism in advanced position with respect to the breech casing; an electrical motor coupled to a drum, said drum having a ramp for actuating said follower; mechanical means sensitive to the position of the breech mechanism with respect to the breech casing and capable of maintaining the bolt out of locking as long as the breech mechanism does not occupy an advanced position with respect to the breech casing; means sensitive to "shot departure" information and adapted momentarily to keep the bolt from locking at the start of the recoil stroke of the breech mechanism and to lock said bolt with said breech mechanism, depending on whether said means receive such information or not; and a feed circuit for supplying an operating current to the external motor, a fire trigger switch adapted to control said operating current, and means for inhibiting said operating current when said means sensitive to said information indicates no "shot departure" information has been received.

2. Weapon according to claim 1, characterized by the fact that said bolt is connected to the breech casing by elastic means adapted to absorb the recoil energy of the breech mechanism.

3. Weapon according to claim 2, characterized by the fact that said bolt, which is of tubular shape, is connected to the breech casing by a rod which traverses it longitudinally and against which it is abutted towards the rear, the rod protruding forward from the bolt in order to be able to be connected to the breech casing by elastic means working in compression in order to absorb the recoil energy of the breech mechanism.

4. Weapon according to claim 3, characterized by the fact that the elastic means are so adjustable that there is a slight longitudinal play between the bolt and its rod, which permits easy rotation of the bolt.

5. Weapon according to claim 1, characterized by the fact that said bolt is a turning bolt with a locking nose in the path of a ratcheting which is integral with a rotary breech head; said bolt having a toothed sector engaging with a slide rack which is subjected, in opposite directions, to the action of a spring on the one hand and of means sensitive to the "shot departure" information on the other hand.

6. Weapon according to claim 5, characterized by the fact that said turning bolt is mounted in a borehole of the breech casing parallel to the axis of the barrel so as to be able both to turn and to slide in said borehole.

7. Weapon according to claim 5, characterized by the fact that the slide rack, is urged elastically outwards in direction transverse with respect to the axis of the barrel so as to cooperate with a ramp borne by a cradle, said cradle being integral with said breech casing, whereby relative motion between the cradle and the breech casing produced from recoil forces said slide rack towards the inside.

8. Weapon according to claim 7, characterized by the fact that mechanical means are associated with the ramp borne by the cradle in order to advance it temporarily with respect to the cradle so as to act on the slide racks in the same manner as if they had retracted with the breech casing with respect to the cradle, in order to eliminate the locking due to a hangfire.

9. Weapon according to claim 5, characterized by the fact that it comprises two such turning bolts, the axes of which are parallel to that of the barrel and by the fact that the two slide racks are slidably mounted in a common housing which is provided in the breech casing, transversely with respect to the axis of the barrel.

10. Weapon according to claim 9, characterized by the fact that a single spring acts simultaneously on the two slide racks.

11. Weapon according to claim 9, characterized by the fact that the mechanical means sensitive to the position of the breech mechanism with respect to the breech casing are formed of elastic push members borne by the breech casing parallel to the axis of the barrel and located in such a manner as to cooperate with the noses of the turning bolts and to be retracted upon each shot by contact with the moving breech mechanism.

* * * * *